US009513046B2

(12) United States Patent
Ramirez et al.

(10) Patent No.: US 9,513,046 B2
(45) Date of Patent: Dec. 6, 2016

(54) HOT LIQUID WASH DEFROSTING METHODS AND SYSTEMS

(71) Applicants: Luis Carlos Gabino Barrera Ramirez, Tepic (MX); Joseph Alvite, Crystal, MN (US); Dwight Vaughn Friedline, Crystal, MN (US)

(72) Inventors: Luis Carlos Gabino Barrera Ramirez, Tepic (MX); Joseph Alvite, Crystal, MN (US); Dwight Vaughn Friedline, Crystal, MN (US)

( * ) Notice: Subject to any disclaimer, the term of this patent is extended or adjusted under 35 U.S.C. 154(b) by 69 days.

(21) Appl. No.: 14/332,083

(22) Filed: Jul. 15, 2014

(65) Prior Publication Data

US 2015/0013354 A1 Jan. 15, 2015

Related U.S. Application Data

(60) Provisional application No. 61/957,897, filed on Jul. 15, 2013.

(51) Int. Cl.
*F25D 21/10* (2006.01)
*F25D 21/00* (2006.01)

(52) U.S. Cl.
CPC ..... *F25D 21/10* (2013.01); *F25D 21/006* (2013.01)

(58) Field of Classification Search
CPC ..... F25D 21/10; F25D 21/006; F25D 21/12; F25D 21/14; F25D 21/02; F25D 21/04; F25D 21/065
(Continued)

(56) References Cited

U.S. PATENT DOCUMENTS 2,686,407 A * 8/1954 Zellner ..... F25D 21/10 62/275
2,748,574 A 6/1956 Gaston
(Continued)

FOREIGN PATENT DOCUMENTS

EP 0059692 8/1983
EP 0238015 9/1987
(Continued)

OTHER PUBLICATIONS

International Search Report and Written Opinion for related PCT Application No. PCT/US2014/046710 mailed Jan. 14, 2015 (11 pages).

*Primary Examiner* — Mohammad M Ali
(74) *Attorney, Agent, or Firm* — Winthrop & Weinstine, P.A.

(57) ABSTRACT

The present disclosure, in one embodiment, relates to a defrosting apparatus comprising a manifold, wherein the manifold is adapted to expel a liquid onto an evaporator component. The apparatus further comprising one or more cold liquid pipes adapted to deliver the liquid to a container, the container comprising a mechanism for heating the liquid. And the apparatus also comprising one or more heated liquid pipes adapted to deliver the liquid from the container to the manifold. The present disclosure includes a computer with tactile monitor, machine vision, video cameras for inspecting, reporting and acting to defrost the freezer evaporator(s), and WiFi capabilities. Freezer access and inventory tracking is controlled by a second camera built onto the outward facing tactile monitor. Facial, pattern, and voice recognition is built into this device to provide reliable security and inventory control.

12 Claims, 10 Drawing Sheets

(58) Field of Classification Search
USPC ..... 62/81, 80, 275
See application file for complete search history.

(56) References Cited

U.S. PATENT DOCUMENTS

| | | | | |
|---|---|---|---|---|
| 3,008,306 | A | 11/1961 | Hiler | |
| 3,772,897 | A * | 11/1973 | Masuda | F25D 21/10 62/282 |
| 3,875,758 | A | 4/1975 | Fischer | |
| 4,041,726 | A | 8/1977 | Mueller et al. | |
| 4,074,987 | A | 2/1978 | Krulewich | |
| 4,226,606 | A | 10/1980 | Yaeger et al. | |
| 4,423,601 | A | 1/1984 | Kramer | |
| 4,488,413 | A * | 12/1984 | Bottum | F25B 40/00 62/503 |
| 4,646,537 | A | 3/1987 | Crawford | |
| 4,727,727 | A | 3/1988 | Reedy | |
| 4,766,734 | A | 8/1988 | Dudley | |
| RE33,968 | E | 6/1992 | Clark | |
| 5,220,807 | A | 6/1993 | Bourne et al. | |
| 6,601,396 | B2 | 8/2003 | Bair, III et al. | |
| 6,691,528 | B2 * | 2/2004 | Stensrud | F25B 41/043 62/344 |
| 6,988,374 | B2 * | 1/2006 | Chang | F25B 39/02 165/133 |
| 7,111,472 | B1 * | 9/2006 | Cloud | F25B 40/00 62/278 |
| 7,171,817 | B2 * | 2/2007 | Birgen | F25B 13/00 62/140 |
| 7,191,604 | B1 * | 3/2007 | Wiggs | F24F 3/14 62/324.1 |
| 8,430,155 | B2 | 4/2013 | Gocze | |
| 2010/0266742 | A1 * | 10/2010 | Ferreira | B01D 5/0015 426/477 |

FOREIGN PATENT DOCUMENTS

| | | |
|---|---|---|
| GB | 2133129 | 7/1984 |
| GB | 2456744 | 7/2009 |

* cited by examiner

HOT LIQUID WASH DEFROSTING METHODS AND SYSTEMS

CROSS-REFERENCE TO RELATED APPLICATIONS

This application claims the benefit of U.S. Provisional Application No. 61/957,897, filed Jul. 15, 2013.

FIELD OF THE INVENTION

The present disclosure relates to freezer and refrigeration techniques. Particularly, the present disclosure relates to use of current freezing methods and new technology to increase efficiency of current appliances.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Refrigeration or freezing of food products is ubiquitous today. Freezing is the current standard method for food preservation, from commercial walk-in/drive-in equipment, to mobile refrigerator/freezer units, to small freezers located in households. Most of the food purchased frozen comes from commercial freezers; fresh food is introduced into household refrigerator/freezers with small freezers to preserve food for consumption as needed. Commercial walk-in/drive-in freezers freeze food products on a large scale, preparing the food for shipment around the corner or around the world. Yet current freezing methods were invented long ago and few improvements have been introduced to the food preservation industry. As a result, current refrigeration and freezing technology and techniques are inefficient and harmful to the environment.

Refrigeration, freezing, or air conditioning may generally describe a method to transfer heat from one area to another. Various appliances and methods exist to create the desired heat transfer. However current methods are inefficient and expensive to operate. Conventional methods of refrigeration use a freezing process where coolant absorbs the heat from the refrigerator or freezer through the evaporator coils and releases heat into the surrounding area through condenser coils. Conventional freezers release this heat into the surrounding room. Current freezing methods are also expensive and inefficient due to current defrost technologies. The evaporator coils in freezers build-up ice and frost and require regular defrosting. Conventional methods suspend the refrigeration process while a defrost mechanism heats the cooling elements with a heating element or hot gas. Once defrosted the refrigeration process may restart. Defrosting is typically controlled by a timer: for every six to twelve hours of refrigeration operation it turns on a defrost mechanism for fifteen to thirty minutes. While defrosting, the temperature in the freezer may rise. Because of a conventional defrost cycle's length and frequency, freezer burn or bacterial growth may occur. Conventional defrost heaters also use extra energy, typically have a power rating of 300 to 800 Watts. The energy expended in defrost heaters, drain heaters, timers, thermostats coupled with the wasted energy expended by the compressor coils makes current freezer technology inefficient.

Thus, there is a need in the art for efficient and environmentally friendly defrost methods for refrigeration and freezer systems.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one embodiment, relates to a defrosting apparatus comprising a manifold, wherein the manifold is adapted to expel a liquid onto an evaporator component. The apparatus further comprising one or more cold liquid pipes adapted to deliver the liquid to a container, the container comprising a mechanism for heating the liquid. And the apparatus also comprising one or more heated liquid pipes adapted to deliver the liquid from the container to the manifold.

The present disclosure, in another embodiment, relates to a method for defrosting evaporator coils to increase tissue preservation, comprising heating a liquid, delivering the liquid to a manifold, expelling the liquid onto an evaporator component to wash away a build-up, capturing the liquid and the build-up, and delivering the liquid to a container.

The present disclosure, in another embodiment, relates to an intelligent appliance system for monitoring, securing, and efficiently using an appliance, comprising a sensor for monitoring activity, the sensor configured to collect data. The system also comprising a computer network configured to link the sensor to an application, the application being a computer program, wherein the application is configured to receive data collected by the sensor. The application further configured to share the data with a user recognition program wherein the data may be processed, resulting in user recognition data and share the data with a system inspection program wherein the data may be processed, resulting in system inspection data. The application then configured to share the user recognition data and the system inspection data with an appliance protocol program, wherein the appliance protocol program may analyze at least one of the user recognition data and the system inspection data to determine an appliance protocol.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous methods and systems of food and tissue preservation. Particularly, the present disclosure relates to novel and advantageous methods and systems to efficiently utilize wasted energy from the refrigeration and freezer processes to defrost evaporator coils.

Figure 1:
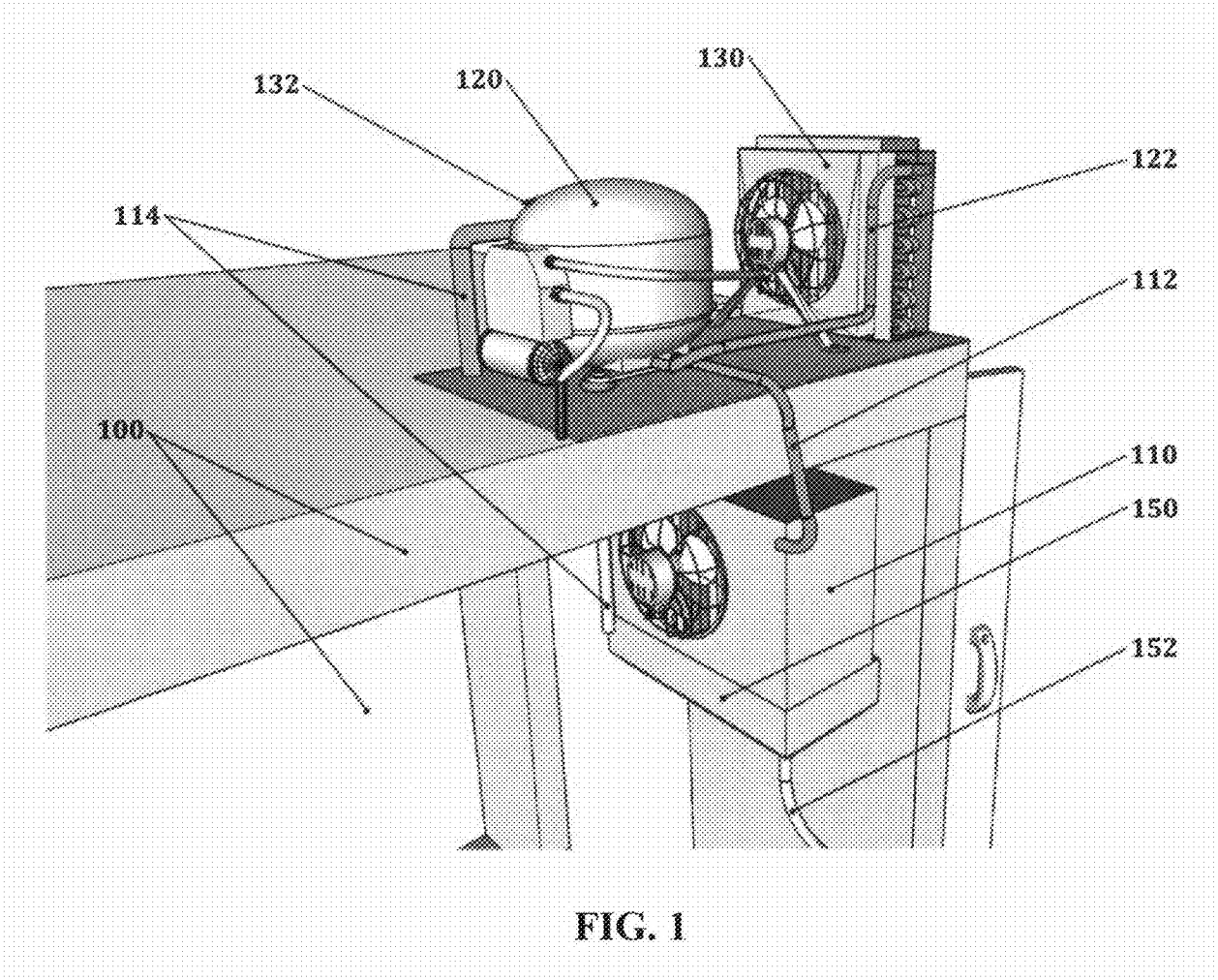
FIG. 1 is a sketch of a conventional walk-in freezer.

FIG. 1 depicts a conventional walk-in freezer with freezer box 100. In this conventional application, a refrigerant that evaporates at near ambient temperature, such as Isobutane, may be used to cool the freezer. The refrigerant may be converted from a liquid into a gas in the evaporator 110. The conversion from a liquid state to gas causes the chemical to become very cold and allows it to absorb heat energy from its surroundings, thereby cooling the refrigerator or freezer. The refrigerant gas is then transported via a suction line 112 to compressor 120. The compressor 120 compresses the gaseous refrigerant and pumps it via tubing 122 to the condenser 130. In the condenser 130, the refrigerant returns to a liquid state, thereby releasing any heat energy it absorbed in the gas state. The heat is then released into the surrounding air. The refrigerant is returned to the evaporator via tubing 114, where the cooling cycle begins again.

During the cooling process, frost forms on the condenser coils, tubing, and fins. Conventional systems typically use an electric heater or hot gas to periodically defrost the condenser coils, tubing, and fins. The melted frost and ice drains to drain pan 150 (herein referred to interchangeably as a wash tray), from which it is delivered to an evaporation tray or floor drain via drain tubing 152.

Figure 2:
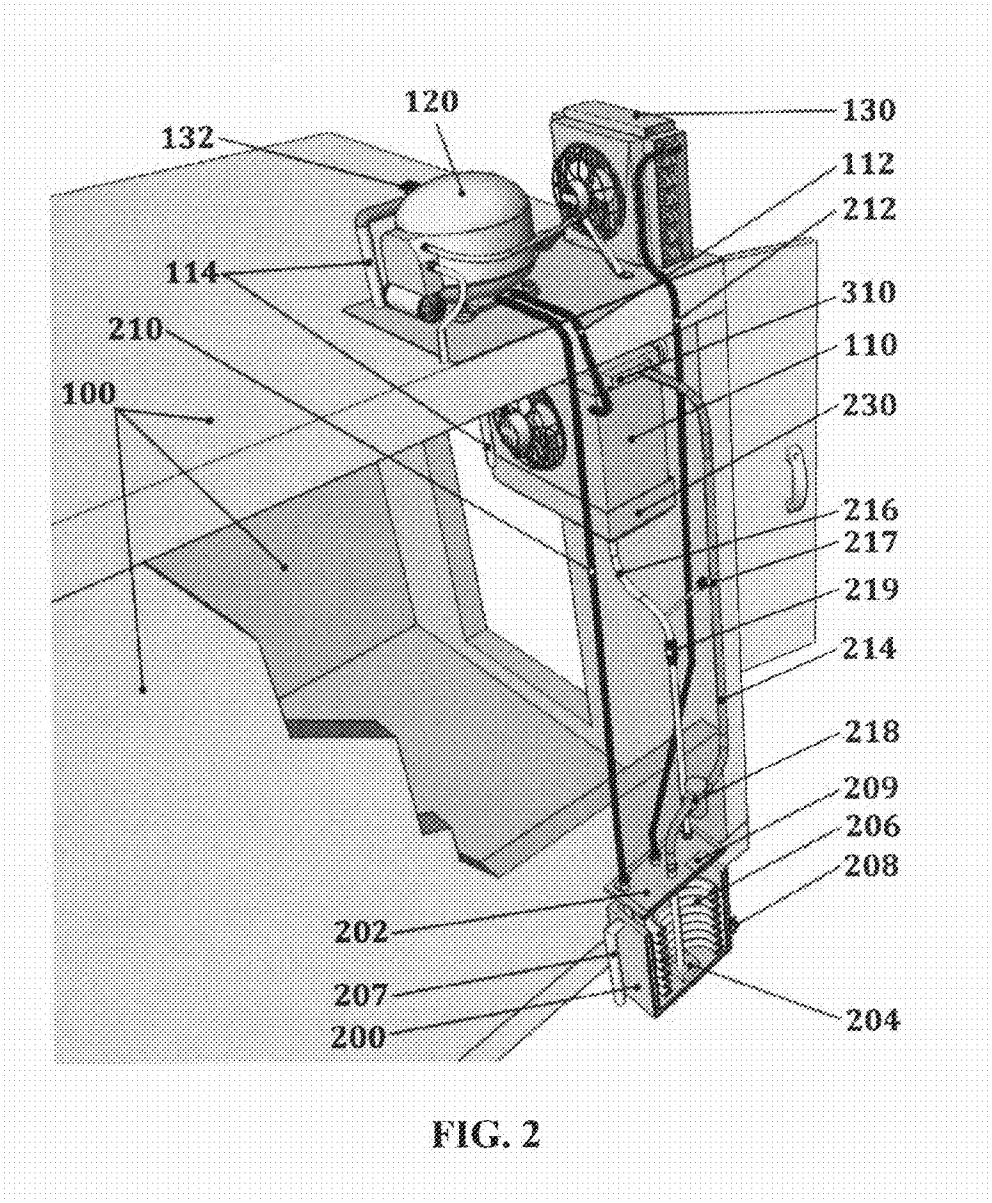
FIG. 2 is a sketch of a walk-in freezer, according to an embodiment of the present disclosure.

Referring to FIG. 2, the walk-in freezer 100 may include various components capable of performing the novel and advantageous methods and systems of the present disclosure. As should be appreciated, zero, one or more components may be located within the freezer 100 walls. Similarly, zero, one, or more components may be located exterior to the freezer 100 walls. Any suitable arrangement and/or location of the various components may be used and is within the scope of the present disclosure. A hot liquid may generally be stored in an insulated container 200. A hot liquid pump 204 may be submerged in the hot liquid. In other embodiments, the hot liquid pump 204 may be external to the hot liquid and/or insulated container 200. The hot liquid may be pumped out of the insulated container 200 through an insulated pipe, or liquid supply pipe, 214. The hot liquid may be carried through the insulated pipe 214 to a hot liquid delivery manifold and tube system, herein manifold 310. The hot liquid may be released on one or more evaporator coils, tubing, and fins (herein evaporator coils 110) thereby washing them. The wash may substantially remove the frost and ice accumulated during the cold frosting and freezing cycle. A wash tray, or catch tray, 230, positioned below the evaporator coils 110, may capture the hot liquid, frost, and ice resulting from the wash. A return pipe, or hot liquid intake pipe 216 may return the captured hot liquid, frost, and ice back to the insulated container 200, resulting in the completing of a cycle.

The insulated container 200 may be heated by a heat exchanger 206, such as coolant coils. The heat exchanger 206 may be part of a cold-hot process (refrigeration process), which may generally be used in conventional refrigeration techniques. The heat exchanger 206 may be filled with a high pressure, hot vapor coolant. As the vapor travels through the heat exchanger 206 it may transfer heat to the hot liquid in the insulated container 200, thereby cooling the coolant, or refrigerant. The cooled coolant may exit the insulated container 200, traveling through tubing, and enter a condenser 130. The condenser 130 may further cool the coolant, releasing excess heat. While cooling, the coolant may have substantially changed to a liquid. Inside the coil system, the cooled liquid coolant may experience a drop in pressure at the thermostatic expansion valve 132. The drop in pressure may cause the liquid coolant to begin to change back to gas. The coolant may enter into evaporator coils 110. The coolant in the evaporator coils 110 may absorb the heat from the surrounding area, resulting in the desired refrigeration or freezing. The coolant in the evaporator coils 110 may substantially change to a gas as it absorbs heat. The coolant may enter a compressor 120. The compressor 120 may compress the low pressure, low temperature gas coolant into a high pressure, high temperature gas coolant. The high pressure, hot vapor coolant may travel through the coil system re-entering the insulated container 200, thus completing a cycle.

Embodiments of the present disclosure may additionally include an intelligent sensor process, or ISP. The ISP may employ one or more cameras, sensors, or computers to monitor user activities around the freezer 100, refrigerator, or appliance. The ISP may also inspect and report the freezing or frost conditions of the evaporator coils. The data may be sent to a local or remote computer by a wired connection, Wi-Fi or any other suitable method.

The Efficient Freezer Method

The efficient freezer method may use heat generated by the refrigeration process, or cold-hot process, to heat a liquid, which can in-turn be used to defrost evaporator coils. The efficient freezer method disclosed may use one or more processes to increase efficient use of energy in freezing and refrigeration including, but not limited to, a hot liquid wash and defrost process, a cold-hot process, and an intelligent sensor process. In various embodiments, the hot liquid wash and defrost process and cold-hot process may run at different times. For example, when the hot liquid wash and defrost process is activated, the cold-hot process may temporarily be suspended until the wash is completed.

The Hot Liquid Wash and Defrost Process

The hot liquid wash and defrost process (HLWDP) may quickly and efficiently remove frost and ice from the evaporator coils. The HLWDP may use a hot liquid wash, herein wash, on the evaporator coils to remove frost and ice build-up. A particularly novel feature of the HLWDP is the utilization of wasted heat from the refrigeration process to replace the conventional electric heater method, in one embodiment. The HLWDP may also decrease defrost cycle times. In some embodiments, the defrost cycle time may be approximately five to ten minutes (conventional systems taking approximately twenty-five to forty minutes). Cutting defrost times may make food less prone to freezer burn and to bacterial growth. By eliminating the electric heater and decreasing defrost times, embodiments of the present disclosure may be more energy efficient. The HLWDP may be comprised of one or more components. In various embodiments, the HLWDP may include, but is not limited to: a storage component, a washer component, a cold reservoir component, and a wash and defrost cycle activation component. The HLWDP may use liquid which may be hot, warm, cool, or cold in various stages of the HLWDP but may be collectively and interchangeably referred to as "hot liquid" herein for ease of reading.

The Storage Component

Figure 3:
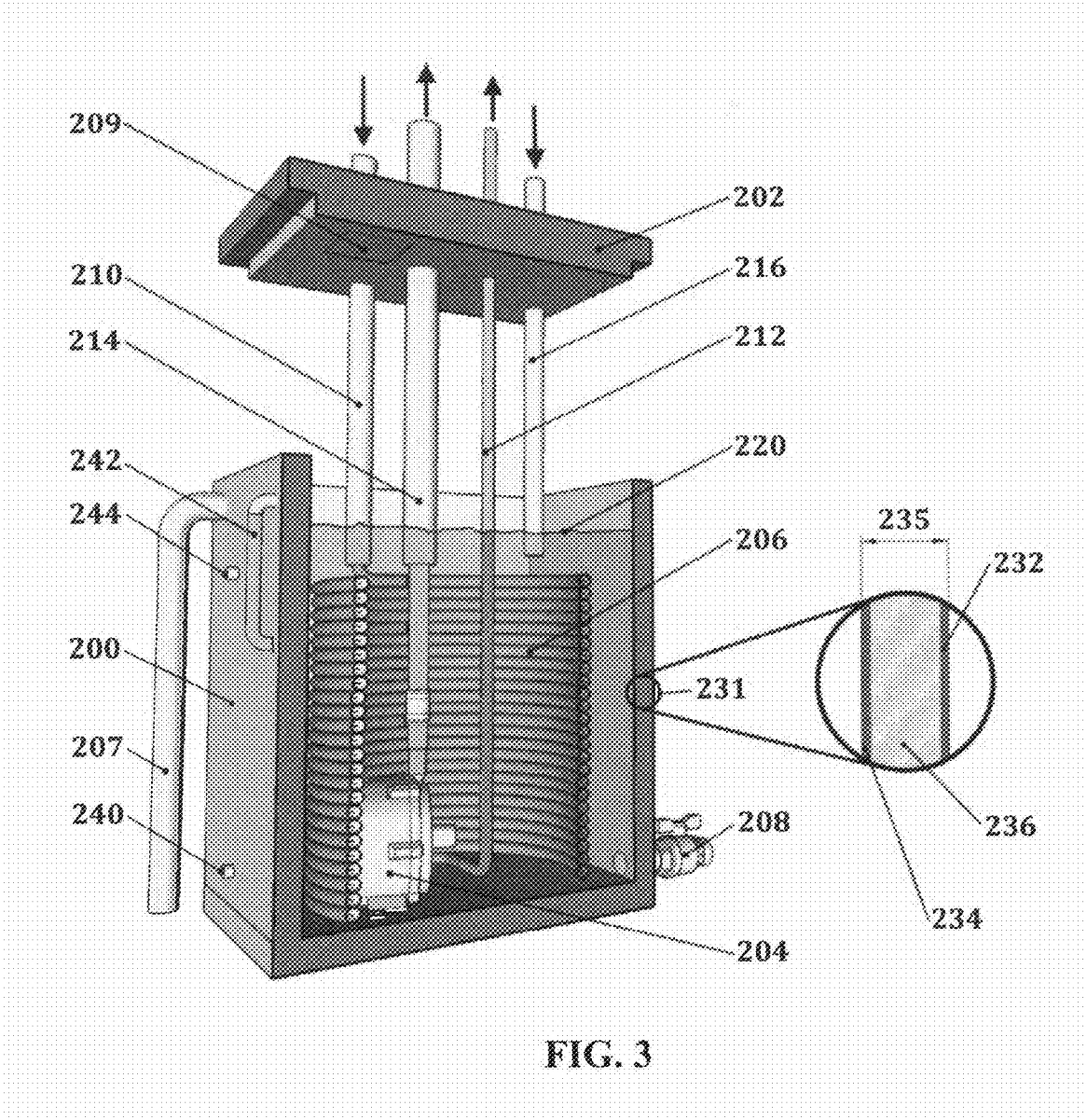
FIG. 3 is a sketch of the insulated container, according to an embodiment of the present disclosure.

The storage component may store hot liquid in a container (herein referred to interchangeably as "insulated container"). The storage component may be comprised of one or more parts, including but not limited to: an insulated container, a drain valve, an overflow valve, a gauge, hot liquid, hot liquid pipes, a hot liquid pump, and a debris trap. Referring now to FIG. 3, an example embodiment of the present disclosure shows a storage component. An insulated container 200 may be a sealed container. In various embodiments, the insulated container 200 may have one or more properties, including but not limited to, being liquid tight, corrosion resistant, and insulated, and/or having a removable inspection panel. Depending on the size and capacity of the refrigerator/freezer unit or any other desirable reason, the container may vary in size, capacity, and shape. As seen in FIG. 3, and in accordance with one embodiment of the present disclosure, the insulated container may be a cube or cuboid. As is to be appreciated, any suitable container shape can be used, such as a cone, cylinder, or sphere, or any custom shape. In various embodiments, the insulated container may open. One embodiment may have a fastener that may unseal the top surface, allowing it to be lifted or removed. However, any suitable method to open the container may be used and is contemplated by the present disclosure. An inspection panel 209 may also be used to gain access to the container 200. While the inspection panel 209 is shown to be on the top surface 202 of the container 200, it should be appreciated that the inspection panel 209 may be located on any suitable surface of the container 200. It may also be appreciated that the inspection panel 209 may comprise any portion, or all, of the top surface 202 or any other surface of the container 200.

In various embodiments, the insulated container walls 231 may have an inner shell 234 and an outer shell 232. The inner shell may be a liquid tight liner. In one embodiment, the container walls may be made from PVC. In another embodiment, the walls may be made of some other suitable plastic. In still another embodiment, the walls may be made of metal. It is to be appreciated; the material composition of the insulated container may contain any number of one or more suitable materials in any number of configurations. In various embodiments, the inner shell 234 and outer shell 232 may cooperate to define an insulation pocket 235. In one embodiment, an insulating material 236 may be positioned within the insulation pocket 235. In some embodiments, there may or may not be an insulation pocket. In one embodiment, the insulation material 236 may be applied to the outer wall of the insulated container 200. In another embodiment, the insulation material 236 may be applied to the inner wall of the insulated container 200. In some embodiments, the insulating material may have an insulation value of 19 R. However, in other embodiments, the insulating materials may have a greater or lesser insulation value.

In various embodiments, a built in drain valve 208 may drain part, or all, of the hot liquid 220 from the insulated container 200 through a drain tube. In one embodiment, the drain valve 208 may be opened manually. In other embodiments, the drain valve 208 may be triggered to open by an automated system in response to a user inputted request, hot liquid overflow of the insulated container, defrost liquid replacement and/or balancing, overheating, system failure, or any other suitable reason. It is understood that one or more combinations of any potential trigger(s) may be used. Some embodiments may, in addition to a drain valve 208, have an overflow valve. An overflow valve may drain any excess hot liquid 220 from the insulated container 200 through an overflow drain tube 207. In one embodiment, the overflow valve may open to release any hot liquid 220 that rises to a point perpendicular with the overflow valve. In another embodiment, the overflow drain tube 207 may be attached to the insulated container 200 at an aperture; any water at or above the aperture may spill into the overflow drain tube.

In one embodiment, the insulated container may have one or more sensors or gauges. A gauge may display one or more pieces of information including, but not limited to: the caloric value of the liquid, the composition of the hot liquid, the average wash time, the last one or more wash times, the temperature of the hot liquid, or the volume of hot liquid. The gauge may transmit information via a local display or through a wired, wireless, Wi-Fi, or any other suitable method to a remote computer. In some embodiments, information may be sent to the Intelligent Sensor Process, discussed below. In one embodiment, the sensors and gauges may include, but are not limited to, a temperature gauge 240, a hot liquid level sensor 244, and a hot liquid level slight glass 242. The slight glass 242 may be a panel or tube having some transparent properties that may allow a user to visually identify the approximate level of the hot liquid 220 within the container 200.

The insulated container 200 may store a hot liquid 220. In some embodiments, the hot liquid 220 may be comprised of water, alcohol (or any other food safe antifreeze), an industrial color pigment, and anti-bacterial and anti-fungal chemicals. The industrial color pigment may aid in leak detection. In one embodiment, the chemical composition of the hot liquid may be seventy-nine percent water, twenty percent alcohol, and one percent color pigment. Water/glycerin mix as well as Water/Propylene Glycol mixes may additionally or alternatively be used, in various embodiments. One skilled in the art may appreciate that any suitable chemical composition may be used. It should be further understood, that any suitable hot liquid may be used. In one embodiment, designed for a walk in freezer, an insulated container may contain approximately 150 liters. For home refrigerators, the hot liquid volume may be less. The hot liquid volume may vary with the size of the evaporator coils. It is understood that any suitable volume of hot liquid may be used.

In various embodiments, the temperature the hot liquid may vary. The heated liquid may range in temperature from 100-230 degrees Fahrenheit, in one embodiment. In another embodiment, the heated liquid may range from 140-170 degrees Fahrenheit. In still another embodiment, the heated liquid may range from 16-200 degrees Fahrenheit. It may be appreciated that the heated liquid may be cooler than 100 degrees or hotter than 230 degrees in still other embodiments. Any suitable temperature may be used and may vary based on factors such as composition of hot liquid, desired speed of the defrost process, size of the evaporator coils, or any other factor.

In various embodiments, the hot liquid 220 may be heated by a heat exchanger 206 housed in the insulated container 200. The heat exchanger 206 may be comprised of hot pipes, in one embodiment. As in the illustrated embodiment of FIG. 3, the heat exchanger 206 may be comprised of coolant pipes shaped in the form of a coil. In another embodiment, the heat exchanger may line the inner wall of the insulated container. In still another embodiment, the walls of the insulated container may contain one or more pockets, the heat exchanger being positioned within one or more of the pockets. It is to be appreciated that any arrangement to heat the hot liquid stored in the insulated container may be used. The hot pipes may be round, oval, square, or any other shape or configuration to optimize space and heat transfer. In various embodiments, the heat exchanger 206 may be comprised or one or more types of exchanges including, but not limited to: shell and tube, straight-tube, U-tube, U-tube bundle, Fin, Plate and Frame, Plate-Fin, counter-flow, cross-flow, or Adiabatic Wheel. However, any suitable method to heat the hot liquid may be used.

In various embodiments, the heat exchanger 206 may be part of the cold-hot process, discussed below. Various embodiments of the present disclosure advantageously house these pipes within the insulated container 200 and use the heat from the coolant pipe 210, 206, 212 to heat the hot liquid 220. The coolant pipe 210 may enter the insulated container 200 through a coolant pipe intake opening. The coolant pipe 206 may be housed within the insulated container 200. The coolant pipes 210, 206, 212 may be filled with a high pressure, high temperature, vaporized coolant, resulting in the heating of the hot liquid 220. The coolant pipe 212 may leave the insulated container 200 through a coolant pipe outtake opening. In some embodiments, the coolant pipes 212, 206, 210 may be made out of copper. In other embodiments, the coolant pipes 210, 206, 212 may be made out of stainless or carbon steel. It may be appreciated that any suitable material may be used to construct the coolant pipes 210, 206, 212.

One or more hot liquid pumps may be submerged in the hot liquid. In some embodiments, a hot liquid pump (HLP) 204 may pump the hot liquid 220, through a hot liquid outtake pipe 214, to the washer component, discussed below. The hot liquid outtake pipe 214 may exit the insulated container 200 through a hot liquid outtake pipe opening. The hot liquid outtake pipe may be made of insulated copper, aluminum, or any other suitable material. In some embodiments, the HLP 204 may not be located within the insulated container 200. For example, the storage component may be situated above the washing component, allowing the hot liquid 220 to travel through hot liquid outtake pipe 214 to the washer component using gravitational forces or a secondary pump. A HLP 204 situated in the washer component may pump the hot liquid 220 back to the insulated container 200, in some embodiments. It is understood that any suitable method for the transportation of the hot liquid between the washer and storage components may be used. The HLP 204 may be any suitably sized pump or combination of one or more pumps.

Referencing back to the embodiment of FIG. 2, a debris trap 218 may capture substantially any and all debris, keeping piping clear of obstruction. The debris trap 218 may be placed next to or within the hot liquid outtake pipe 214. In another embodiment, a debris trap 218 may be located within the HLP 204. In another embodiment, a debris trap 218 may be located next to or within the hot liquid intake pipe 216. In some embodiments, there may be one or more debris traps. A debris trap may be placed in any suitable location to collect debris. In some embodiments, the debris trap may be periodically replaced, cleared, or cleaned, for example and example only, every quarter. In another embodiment, there may be an automatic disposal or flush that may occur automatically or upon user request.

In some embodiments, the hot liquid 220 may return from the wash component via the hot liquid intake pipe 216. In various embodiments, the hot liquid intake pipe 216 may traverse the wall of the freezer 100, thereby existing external to the freezer 100. In at least one embodiment, a check valve 219 may be located on the hot liquid intake pipe 216 after the hot liquid intake pipe 216 exists. The check valve 219 may control heat loss via the drain using a one-way valve. The pressure of water may open the valve 219, allowing water to flow through, but as soon as the water stops flowing the valve 219 may close. The check valve 219 may be normally closed and may open only when the hot liquid is flowing through it. However, in some embodiments, the check valve may open at any suitable time. The check valve 219 may be a spring valve, in one embodiment, however any appropriate one-way valve may be suitable. In some circumstances, the check valve 219 may become frozen or locked into place due to frost. A drain defrost valve 217 may be used in such a circumstance. The drain defrost valve 217 may release hot liquid 220 into pipe 216, thereby warming and defrosting the check valve 219. Any suitable method to warm the check valve may be used. The hot liquid intake pipe 216 may enter the insulated container 200 through a hot liquid intake opening. In one embodiment, the hot liquid intake pipe may be a PVC insulated pipe. However, any suitable material may be used to construct the hot liquid intake pipe.

The gauge, hot liquid intake pipe 216, hot liquid outtake pipe 214, coolant intake pipe 210, coolant outtake pipe 212, overflow drain tube 207, drain valve 208 and tube, or any other entry and/or exit locations (and their respective openings) on the insulated container 200 may be sealed by one or more methods including, but not limited to, caulking, welding, liquid tight o-rings, washers, or any other suitable method.

The particular orientation, location, and/or placement of one or more of the aforementioned parts on the insulated container 200 may vary. In some embodiments, all the intake and outtake pipes, the gauge, and the drain pipes may be placed on the top surface 202 of the insulated container. In another embodiment, one or more parts may protrude from one or more side surfaces of the insulated container. In still another embodiment, one or more parts may protrude from the bottom surface of the insulated container. Any suitable orientation may be used.

The Washer Component

The washer component may substantially remove the frost and ice build-up from the evaporator coils. The washer component may be comprised of one or more parts, including but not limited to: a wash hood, evaporator coils, and a wash tray. The wash hood may comprise one or more parts including but not limited to a distributor hood 300, a manifold 310, and one or more distributors 320. The distributor hood 300 may provide a cover or top for the evaporator and housing for the components listed herein. The distributor hood 300 may also serve as a mounting point for the manifold and/or distributor hangers.

Figure 4:
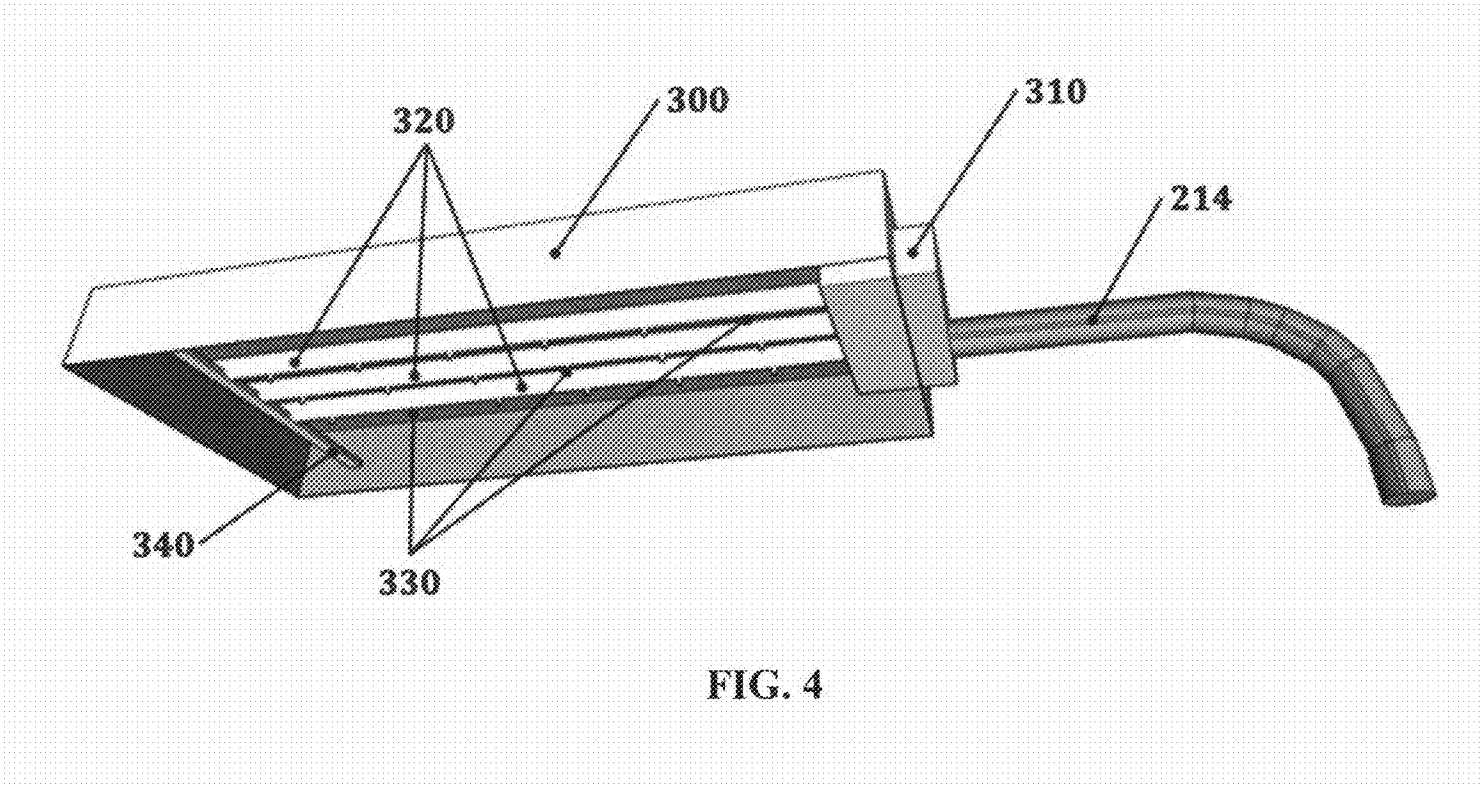
FIG. 4 is a sketch of the washer component, according to an embodiment of the present disclosure.
Figure 5:
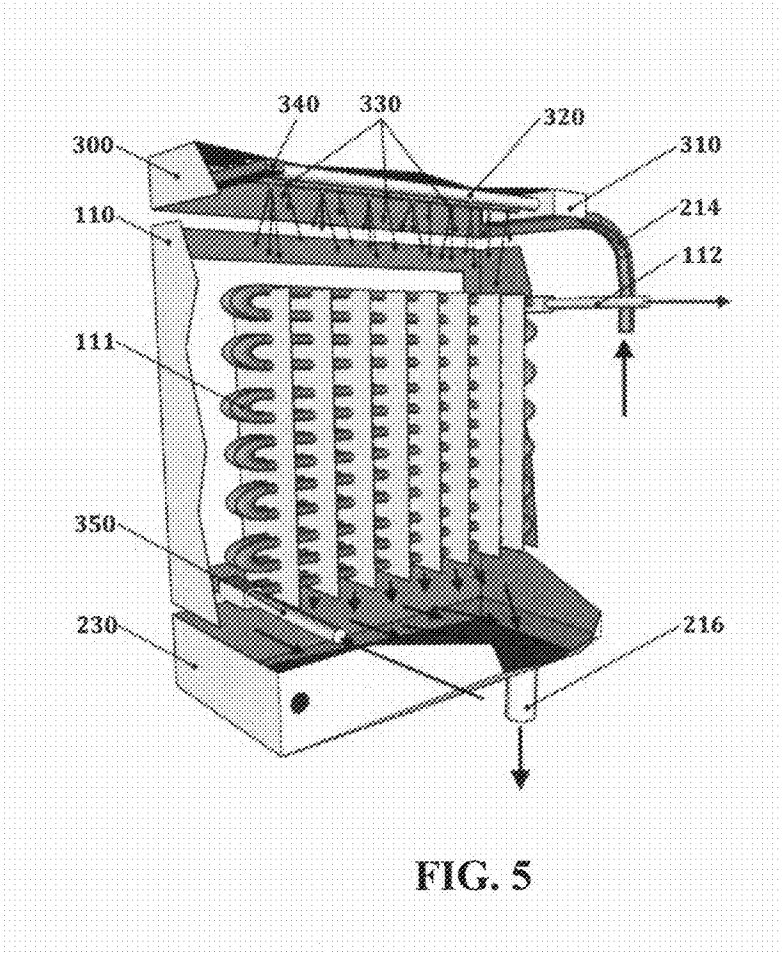
FIG. 5 is a sketch of the washer and evaporator components, according to an embodiment of the present disclosure.

In the embodiment illustrated in FIGS. 4 and 5, the hot liquid 220 in the hot liquid outtake pipe 214 may be pumped to a hot liquid delivery manifold, (herein referred to interchangeably as "manifold") 310. In one embodiment, the manifold 310 may be comprised of one or more distributors 320. In another embodiment, one or more distributors 320 may attach to the manifold 310. The one or more distributors 320 may be attached via docks, the docks located on the original manifold. The manifold 310 may be adjusted by length or number of docks, in various embodiments.

The distributors may be comprised of one or more parts. In one embodiment, the parts may include but are not limited to, one or more distributor ports 330 and one or more distributor hangers 340. The distributor port 330 may be comprised of small holes or nozzles located on the distributor 320. The distributor port 330 may allow for substantially uniform dispersal of the hot liquid over the evaporator coils 110, 111. The distributor ports 330 may be adjusted to optimize the washing of the evaporator coils 110, 111. The distributor ports 330 may have fixed size, direction, and/or output volume, in some embodiments. In other embodiments, the distributor ports 330 may have adjustable size, direction, and/or output volume. In some embodiments, the direction and/or output may be motorized and/or controlled by the system. In at least one embodiment, the distributors 320 may be adjustable by length, position, distance between ports, the number of ports present, the size or ports, etc. The distributor hangers 340 may have one or more secondary docks for the distributor 320 to attach. The distributor hangers 340, like the manifold, may be adjusted by length and/or the number of docks present. The distributor hangers 340 may attach the distributor hood 300 at a point distal to the manifold 310.

The manifold 310 and distributors 320 may, generally and in cooperation, substantially evenly direct the hot liquid 220 to each of the attached distributors. The manifold 310 and distributors 320 may be substantially aligned with the evaporator coils 110, 111. The hot liquid 220 may be released by the distributor ports 330 and may wash away built-up frost and ice, thereby removing it from the evaporator coils 110, 111. The wash may continue until substantially all frost and ice has been removed. In one embodiment, the wash time may be a set period, such as 5 minutes. In another embodiment, the wash time may vary depending on the time since the last wash. For example, one minute of wash for every hour since the last wash was performed. In other embodiments, the wash may be monitored by an intelligent sensor process, as discussed below. Any suitable method to administer the wash and wash times may be used.

The manifold 310, distributors 320, distributor ports, 330, and/or distributor hangers 340 may be made from a corrosive resistant material. In some embodiments, the manifold 310, distributors 320, distributor ports, 330, and distributor hangers 340 may be made from copper. However, in other embodiments, aluminum, plastic, or any other suitable material may be used. In some embodiments, the manifold, distributors, and distributor ports may be designed to match the shape of the evaporator tubing, thereby enhancing the efficiency of the wash.

In various embodiments, a wash tray 230 may be located underneath the evaporator coils 110, 111. The hot liquid, frost, and ice may be captured in the wash tray 230. The wash tray 230 may have high sides, in some embodiments, to eliminate over spray and over flow of the hot liquid into the freezer compartment. The wash tray 230 may be made of a corrosion resistant material. In one embodiment, the wash tray may be made of PVC. In another embodiment, the wash tray may be made of aluminum. However, in other embodiments, the wash tray may be made of any suitable material(s). In various embodiments, the wash tray may have a hot liquid return opening 216. The hot liquid return opening may be the same as the hot liquid intake pipe 216, thereby returning the hot liquid to the storage component to be reheated and stored for further use. In other embodiments, a pump may be used to pump the hot liquid, frost, and ice mixture back to the insulated container or to a cold liquid reservoir, discussed below.

The system may have a tendency to gain water due to the melted frost and ice build-up washed away and collected by the wash tray. Because of the low volume of liquid generated or added by the build-up, substantially no or little change may occur in the composition of the hot liquid. However, in various embodiments, a test and/or rebalance of the hot liquid composition may be performed. In some embodiments, a sensor may monitor the composition. The sensor may relay or display the composition, in some embodiments. An automated injection process may balance the composition of the hot liquid by adding in one or more other liquids or additives in order to maintain balance, in at least one embodiment. In another embodiment, the user may inject one or more liquids or additives based on the sensor information. In still another embodiment, a user may manually test and/or balance the chemical make-up, or composition, of the hot liquid.

The Cold Reservoir Component

Figure 6:
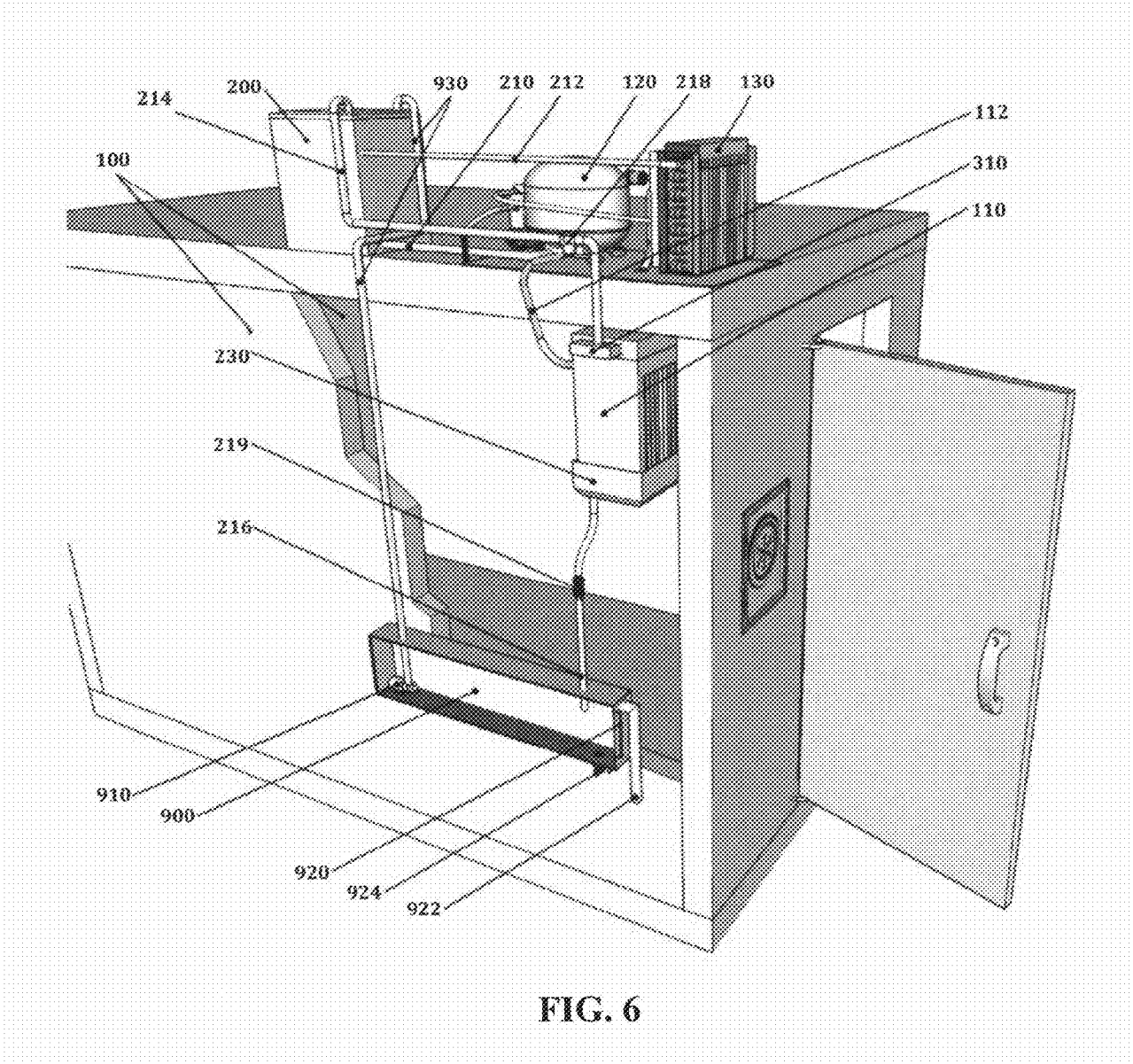
FIG. 6 is a sketch of a walk-in freezer, according to an embodiment of the present disclosure.

In various embodiments, and with reference to FIG. 6, a cold reservoir 900 may be used to temporary store the hot liquid 220 (which may be cool or cold in temperature) after being collected by the wash tray 230, but before returning the hot liquid 220 to the insulated container 200. A cold reservoir 900 may be used, for example, when the configuration requires that the insulated container 200 by placed at a position higher than the wash tray 230. Similar to the insulated container, the reservoir 900 may have an access area, such as a removable top or side. In addition, the reservoir 900 may include one or more components, including but not limited to, a pump 910, a sight glass 920, an overflow tube 922, a drain valve 924, and a transfer tube 930. The pump 910 may be submersible, in some embodiments. The pump 910 may be low voltage, in some embodiments. In other embodiments, the pump may not be submerged and/or may be any voltage. The pump 910, may transfer the hot liquid 220 to the insulated container 200 via the transfer tube 930 for reheating. In other embodiments, as discussed, the wash tray 230 may include a pump capable of pumping the hot liquid directly to the insulated container 200, thereby making the reservoir 900 unnecessary. It may be understood that any suitable arrangement may be used.

The Wash and Defrost Cycle Activation Component

The wash and defrost cycle may be activated by turning on the HLP. The hot liquid may travel from the insulated container to the manifold where it may wash the evaporator coils. The wash and defrost cycle may be activated by one or more methods. In one embodiment, the wash and defrost cycle may be activated on a timer. For example, every 6 hours the wash and defrost cycle is activated. In another embodiment, the wash and defrost cycle may be activated by build-up on the evaporator coils reaching a pre-determined thickness, as monitored by cameras or sensors. A camera positioned to monitor the thickness of the frost and ice build-up may, for example and example only, activate the wash and defrost cycle when the build-up thickness reaches 0.25 centimeters. In other embodiments, greater or less than 0.25 centimeters of build-up thickness may activate the wash and defrost cycle. In still another embodiment, the wash and defrost cycle may be activated using a variety of analyzed factors by an intelligent sensor process (discussed below). However, any method activating and controlling the duration of the wash and defrost cycle may be used.

THE Cold-Hot Process

The cold-hot process, or freezing cycle, may be used to cool or freeze the refrigerator and freezer compartments, as well as heat the hot liquid used in the HLWDP. The cold-hot process may be a closed loop. The cold-hot process may comprise one or more parts including, but not limited to: a compressor, a hot liquid heat exchange, a condenser, a thermostatic expansion valve, and an evaporator. The loop may contain one or more loops of pipes that pass through one or more of the aforementioned parts.

The piping may contain a coolant. In some embodiments the coolant may be comprised of isobutane. In other embodiments, the coolant may be a Freon, R-22, R 410a, R134a, any suitable cryogenic fluid with a relatively low boiling point, or any other suitable fluid. The boiling point of a closed-system liquid can be controlled by changing the vapor pressure. The coolant may be pushed through the pipes by a pump, gravity, pressure gradients, or any other suitable method. The coolant pipes, in part, make up the heat exchange, discussed above.

The Compressor

Figure 7:
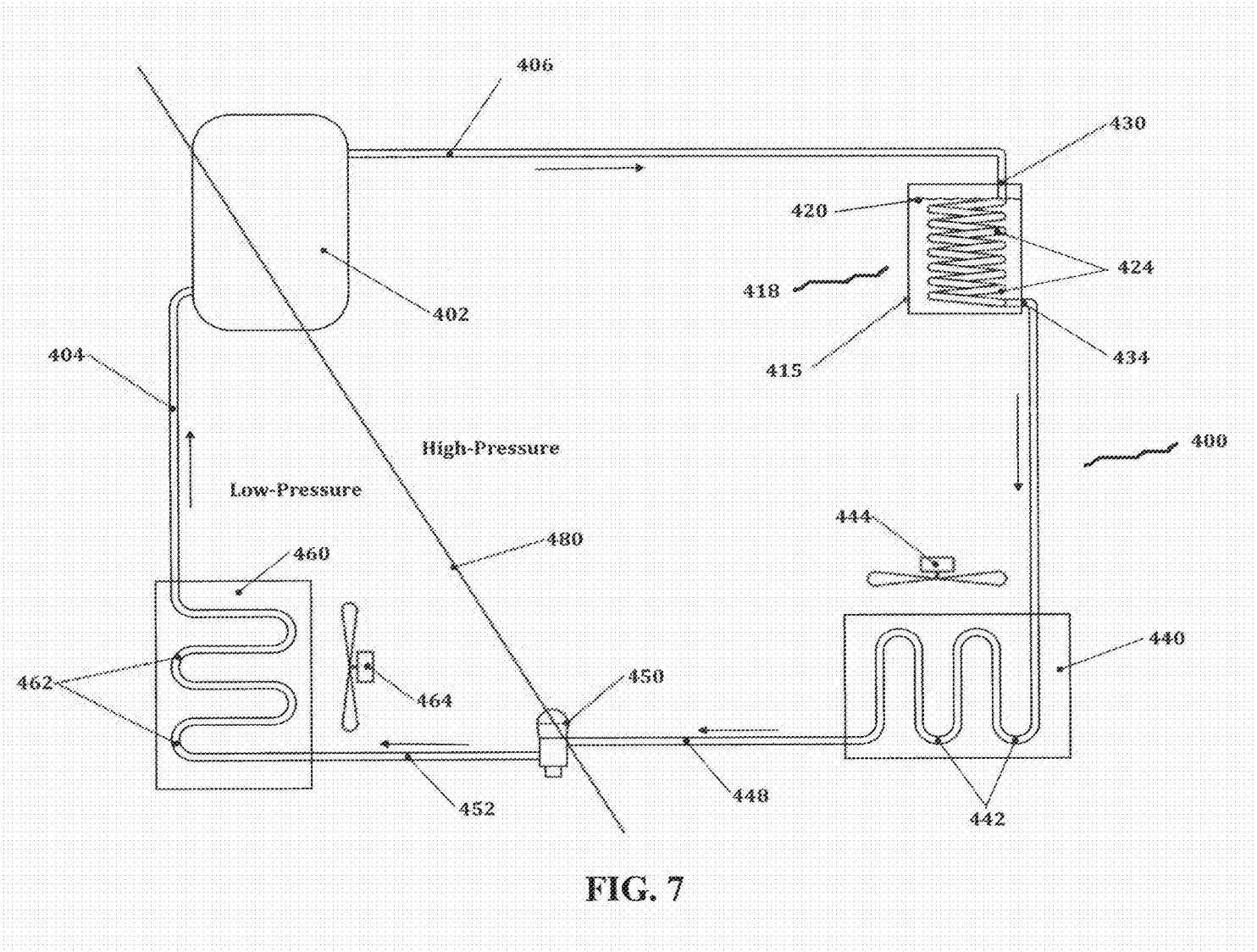
FIG. 7 is a flow chart of a cold-hot process, according to an embodiment of the present disclosure.

As seen in FIG. 7, a compressor 402 may have two coolant pipes emerging from it. The inlet, or suction, coolant pipe 404 may bring in low pressure, low-temperature (LTLP) vapor from the evaporator 460. The compressor 402 may compresses the coolant vapor until it becomes high-pressure, high temperature (HTHP) superheated vapor. The HTHP superheated vapor may exit the compressor through the outlet, or discharge, coolant pipe 406.

The Hot Liquid Heat Exchange

In embodiments of the present disclosure, the HTHP vapor may enter the hot liquid heat exchanger 418, or storage component, at the coolant pipe intake opening 430. As discussed above, the coolant pipes 424 may be housed within an insulated container 415, in order to serve as a heat exchanger for the hot liquid. The HTHP vapor may heat the coolant pipes 424, as it travels through the hot liquid heat exchanger 418. In some embodiments, the coil shaped coolant pipes 424 may be used to heat the hot liquid 420. The heat from the coolant pipes 424 may transfer to the hot liquid 420, resulting in a cooling of the coolant as it heats the hot liquid 420. As the HTHP vapor cools, the coolant may begin to turn from a vapor (gas) into a liquid. The coolant may remain high-pressure (HP). The HP coolant may exit the hot liquid heat exchanger 418 at the coolant pipe outtake opening 434.

The Condenser

In some embodiments, the HP coolant may enter a condenser 440. In various embodiments, the condenser may further cool the HP coolant. The HP coolant may enter the condenser 440 and pass through the condenser coils 442. As the coolant traverses the condenser coils 442, a condenser fan 444 may disperse heat, allowing the coolant to further cool. The result of the cooling may cause the HP coolant to become substantially liquid. The HP coolant may exit the condenser 440 as a sub-cooled HP liquid.

The Thermostatic Expansion Valve

A thermostatic expansion valve (TEV) 450 may exist between the condenser 440 and evaporator 460. The sub-cooled HP liquid coolant may enter a thermostatic expansion valve. A thermostatic expansion valve 450 may have a narrow restriction. On the condenser 440 side of the coolant pipes 448 a cooled high-pressure environment may exist. On the evaporator 460 side of the coolant pipes 452 a cooled low-pressure environment may exist. As the coolant is pushed through the TEV the drop in pressure may cause some of the liquid coolant to near instantaneously become vapor. This low pressure drop may cause the coolant to absorb heat.

The Evaporator

In various embodiments, the coolant may enter the evaporator 460. The evaporator may generally be situated in the freezer, refrigerator, or any other area desired cooled. The evaporator 460 may still be a low pressure environment. The coolant may be pushed through the evaporator coils 462. As the LP coolant continues to absorb heat, the temperature of the coolant pipes drops. An evaporator fan 464 may disperse the cooled air. The liquid LP coolant may, as it absorbs heat, begin to boil before substantially changing to vapor. The LP vapor coolant may exit the evaporator 460 before entering into the compressor 402.

The pressure line 480 in FIG. 7 may distinguish the high pressure and low pressure components. The aforementioned process is understood to be one embodiment of a cold-hot process. Any suitable method to refrigerator, freeze, or transfer heat may be used.

The Intelligent Sensor Process

The intelligent sensor process (ISP) may use a network of one or more components, including but not limited to, sensors, cameras, computers, and/or user inputs to efficiently manage an appliance. The ISP may have one or more programs that monitor one or more aspects of the appliance. The ISP may monitor appliance use through an appliance and user pattern recognition program, in some embodiments. The ISP may monitor the appliance systems and components through a system inspection program, in some embodiments. Other programs may exist in other embodiments.

Appliance and User Pattern Recognition Program

In various embodiments, an appliance may have one or more computers. In some embodiments, a computer may have a built-in display. In one embodiment, the built-in display may have a user interface. The display may be touch screen in some embodiments, or have a keyboard or keypad in other embodiments. However, any method to interact with the system may be used.

The user pattern recognition may employ one or more methods to gather information on or from a user, including but not limited to: cameras, sensors, gauges, user-interface interactions, microphones, or other suitable methods. This information may be used to monitor user activity, predict future behaviors, and establish an efficient HLWDP routine. This information may also be used for security purposes to monitor access or to deny a user access to the appliance, in some embodiments.

User Activity

Figure 8:
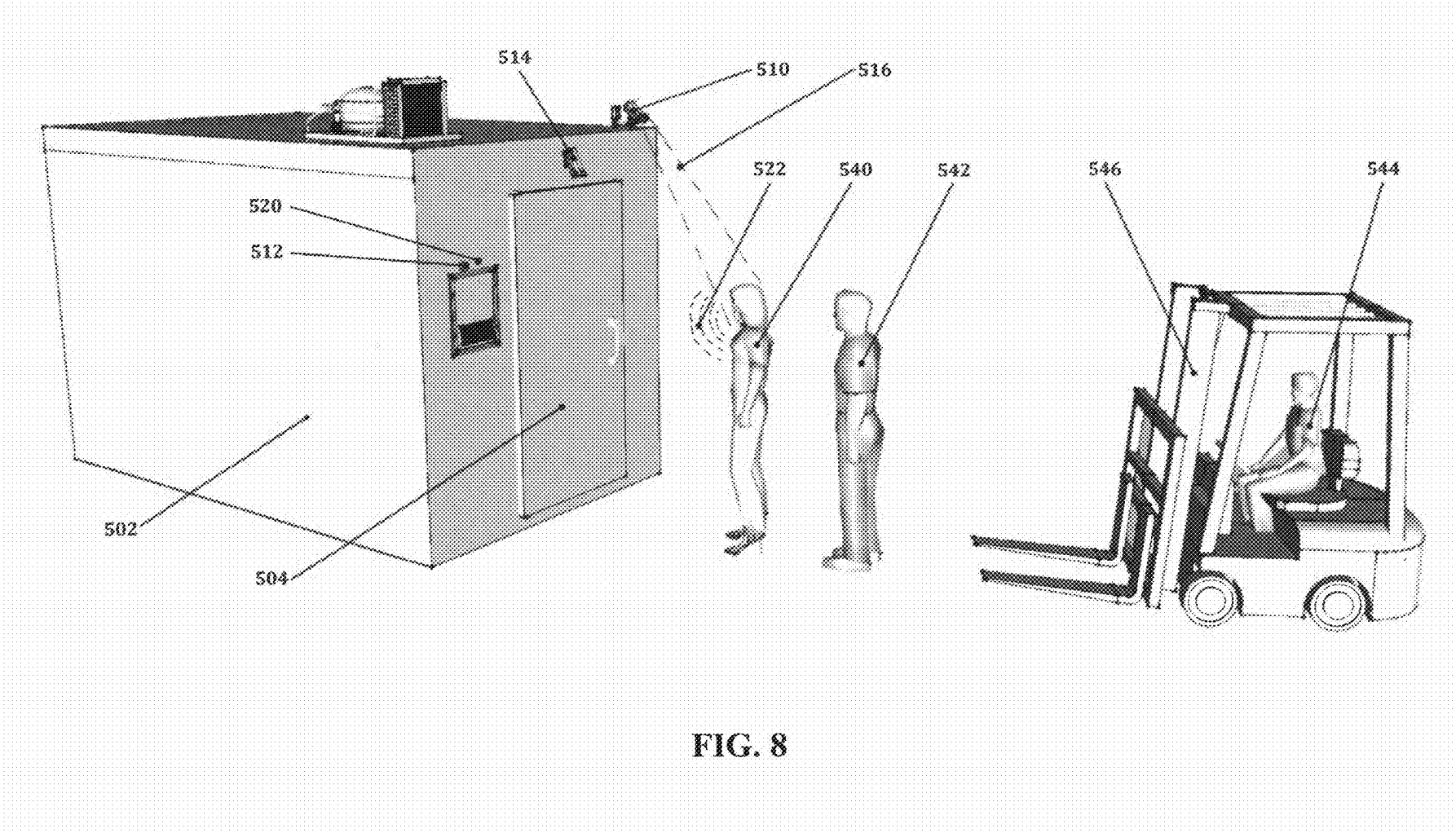
FIG. 8 is a sketch of an intelligent appliance system, according to an embodiment or the present disclosure.

Referring to FIG. 8 and in various other embodiments, one or more cameras 510, 512, 514 or sensors may be set up to monitor appliance 502 activities. The system may monitor users opening the freezer compartment, user traffic, monitoring of product stocking, product destocking, product volume levels, temperature reports, and/or many other options.

In some embodiments, a user may enter information on the display screen, keyboard, keypad, or any other suitable device. In some embodiments, the user inputted information may include but is not limited to, a passcode or passkey to enter the appliance, the product to be stocked or destocked, or any other suitable information. The information, including password, may be user specific, resulting in the tracking of individual users of the appliance. The information may be recorded as user information and sent to one or more computers.

One of the one or more cameras may be positioned to monitor user traffic. For example, a camera 514 or one or more sensors may monitor the time and duration a door 504 is open on an appliance 502. A camera 510, 512, 514 may also monitor the movement of people 540, 542, 544 or vehicles 546 through or around a unit door 504. In one embodiment, information related to opening or entering the door 504 of the appliance 502 may be captured and stored. Information related to opening or entering of the door may include, but is not limited to: time of day, duration the door was open, amount of occupants who entered or exited appliance, duration of occupant stay in appliance, individual(s) who gained access, or any other useful information. This user information may be stored, saved, or sent to one or more computers by any suitable method.

A camera may collaborate with one or more computers in such a way as to employ an artificial intelligence program. In some embodiments, a vision algorithm software may be used to analyze user activity. The vision algorithm software may train the computer system to recognize the user(s) of the appliance. For example, a camera 510, may capture 516 the facial image of person 540. The vision algorithm software may be capable of analyzing a user's facial features to recognize the individual user. In some embodiments, a voice recognition software may be used. A microphone 520 may receive an audio signal 522 from a person 540. The voice recognition software may be capable of analyzing a user's particular vocals to recognize individual users. User information on user activity may be collected, including but not limited to: time of day user accesses appliance, frequency user accesses appliance, duration door is open during each appliance access, duration user spends inside appliance, or any other useful information. User information may be collected for one or more users.

One or more computers may analyze the user information to determine the most efficient way to use the HLWDP. For example, the user information for a commercial appliance may show that general user activity is regular or substantial between the hours of 9 am to noon but that the appliance is rarely used between noon and 5 pm. Another example, may show a family's user activity. The family activity may show that a first user generally uses the appliance once in the morning and twice in the evening, with the door open for an average of forty-five seconds. A second user may generally use the appliance every weekday between 3 pm and 5 pm with an average door open time of 5 minutes. A third user may generally only use the appliance one day a week but may have the appliance door open for a substantial period, such as 15 minutes to unload groceries. Any number of different user activities may be collected and analyzed. The wash cycles start times and durations may be timed to best utilize energy, given this information.

Security

The computer(s) may use the recognition to interface with the user(s). It may greet a user, display information about user activity, or display information obtained from the one or more cameras, sensors, or gauges. The system may also use the information and/or user interface for security purposes. The vision algorithm software, or user recognition, may be used to grant or deny access to users. The voice recognition software may also be used to grant or deny access to users. In one embodiment, the software may require a certain passcode to be spoken, for example, "Open Sesame." In other embodiments, a user may speak any number of one or more words in order to be recognized. In other embodiments, a username and or passcode may be entered on the touchscreen display, keyboard, or keypad.

In one example, the door 504 may unlock for person 540 and person 544 after the system recognizes the users face and/or voice. However, the system may not have access information on person 542. If person 542 tries to open the door 504 access may be denied, an alarm may sound, and/or the user may be photographed, the image being transmitted to the system. This may be useful, for example, to allow one or more scientists access to a cryogenic freezer but deny access to unauthorized persons. In some embodiments, the security system may be time sensitive. In one embodiment, a user may be locked out of the appliance for a limited period. For example, a child user may be locked out of the appliance for the ninety minutes preceding dinner. In another embodiment, a freezer being used for experimental purposes may deny access to one or more users for the duration of the experiment.

The user-interface may also grant or deny access based on a passcode or passkey that a user may enter using the screen, keypad, or keyboard.

System Inspection Program

Figures 9, 10, 11:
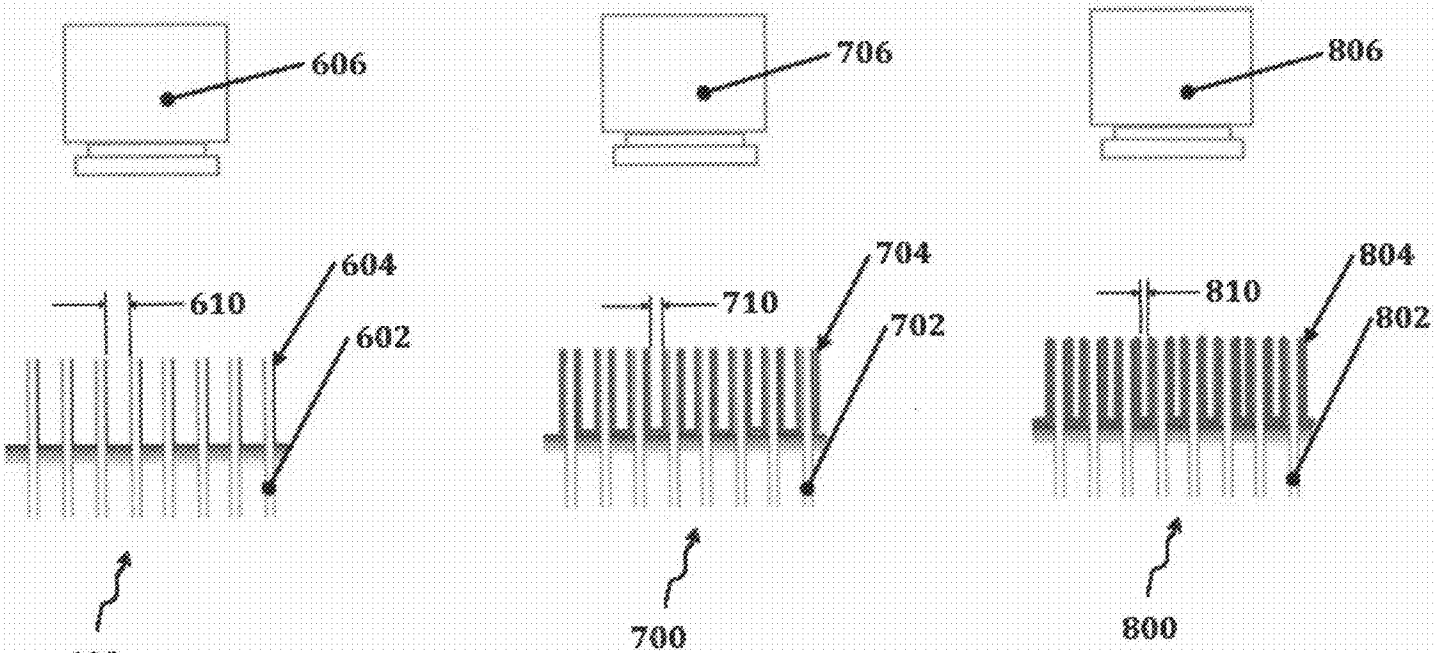
FIG. 9 is a sketch of an evaporator coil in the defrosted stage, according to an embodiment of the present disclosure.
FIG. 10 is a sketch of an evaporator coil in the defrost recommended stage according to an embodiment of the present disclosure.
FIG. 11 is a sketch of an evaporator coil in the defrost required stage according to an embodiment of the present disclosure.

In various embodiments, one or more cameras may be positioned to view the evaporator coils. In some embodiments, one or more cameras may be configured to capture or monitor the various freezing stages of the evaporator coil. In at least one embodiment, a vision algorithm may be used. Referring to FIGS. 9-11, a camera 606, 706, 806 may measure or monitor the clearance 610, 710, 810, or the distance of open space created between two or more of the evaporator coils 602, 702, 802. The clearance 610, 710, 810, may be inversely related to the amount of frost and ice build-up (herein referred to interchangeably simply as "build-up") 604, 704, 804. That is, as the build-up 604, 704, 804 grows on the evaporator coils 602, 702, 802 the clearance 610, 710, 810 between the coils 602, 702, 802 may decrease. In various embodiments, the system may identify one or more build-up stages. For example and example only, one embodiment may have three build-up stages: defrosted 600, defrost recommended 700, and defrost required 800. In other embodiments, there may be three, more than three, or less than three build-up stages.

In various embodiments, as represented in FIG. 9, a defrosted build-up stage 600 may indicate the evaporator coils 602 have been recently defrosted or have sufficient clearance 610 between two or more evaporator coils 602 such that undergoing a defrost process may be unnecessary. When the evaporator coils 602, have been defrosted there may be no or substantially little build-up and the clearance 610 may be a substantially maximum clearance. As the build-up 604 grows, the clearance 610 may decrease. As should be appreciated, a defrosted build-up stage 600 may have a clearance 610 having a range of thicknesses. The accepted thickness range for clearance 610 may be pre-determined, in various embodiments. In other embodiments, the range for clearance 610 may be selected by the user. In still other embodiments, the range for clearance 610 may be dynamic, such that the range is automatically adjusted to increase efficiency. In various embodiments, the clearance 610 may decrease from the build-up 604 such that the clearance 610 is no longer in the accepted range and thus the defrosted stage 600 may have ended.

In various embodiments, as represented in FIG. 10, the evaporator coils 702 may have build-up 704 that creates a clearance 710 or clearance range, which may define the defrost recommended build-up stage 700. In various embodiments, the clearance 710 may be thinner than the clearance 610. Similar to the clearance 610 described above, the clearance 710 that defines the defrost recommended build-up stage 700 may exist over a range of thicknesses. The range may be pre-selected, selected by the user, or dynamic. The clearance 710 may, similarly, continue to decrease from the build-up 704 such that the clearance 710 is no longer in an accepted range and thus the defrost recommended stage 700 may have ended.

In various embodiments, as represented in FIG. 11, the evaporator coils 802 may have build-up 804 that creates a clearance 810 or clearance range, which may define the defrost required build-up stage 800. The clearance 810 may be thinner yet than the clearance 710. In at least one embodiment, the clearance 810 may represent no, or substantially no clearance. That is the build-up 804 may have grown to a point where no open space exists between the two or more evaporator coils 802.

In some embodiments, when the clearance 610, 710, or 810 has a given thickness, the camera 606, 706, or 806 may send a signal to one or more appliance computers, including but not limited to, continue freezing, stop freezing, initiate HLWDP, initiate HLWDP at next opportunity, etc. It may be appreciated that that any number of build-up stages may be used. It is should be further understood that the use of one or more cameras or sensors to detect frost build-up may be used to start the HLWDP. While in the defrost stage 600, the system may signal that initiation of the hot liquid wash or defrost process should not occur. In other embodiments, the system may signal that initiation of the hot liquid wash may be inefficient, but may be initiated, if desired. Unlike the defrosted stage 600, the defrost recommended stage 700 may indicate that it may be efficient to initiate a defrost process, under certain conditions. For example and example only, the system may or may not initiate the hot liquid wash or defrost process based on user activity or user activity patterns, depending on how it may affect overall efficiency. A camera 706 that recognizes a clearance 710 may send a signal to the system indicating that a hot liquid wash is recommended, but may not be necessary. Once the defrost required stage 800 has been reached, a signal may be sent to the appliance to stop the freezing cycle and start the HLWDP immediately, substantially immediately, at the next opportune time, or at any suitable time.

One skilled in the art may appreciate that the camera 606, 706, 806 may additionally or alternatively measure or monitor the frost and ice build-up (build-up) 604, 704, 804 on an evaporator coil 602, 702, 802 in order to determine which of the one or more build-up stages currently exist. That is, the thickness of the build-up 604, 704, 804 may be used additionally or alternatively to the thickness of the open space or clearance 610, 710, 810 created, thereby yielding a substantially similar result.

Figure 12:
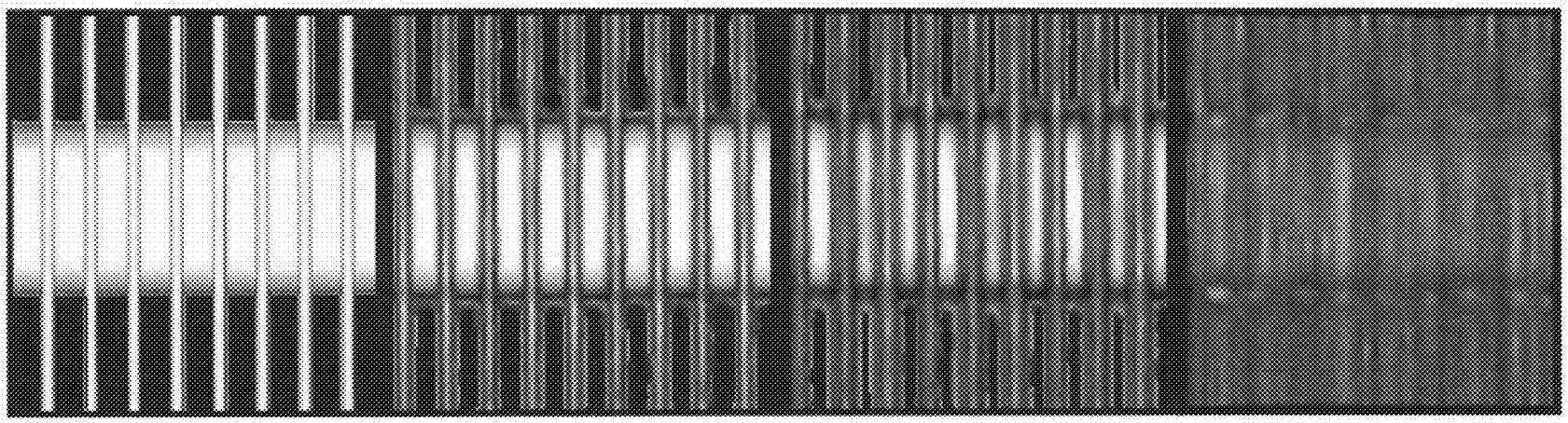
FIG. 12 depicts a camera perspective of frost and ice build-up on evaporator coils, according to an embodiment of the present disclosure.

Referencing FIG. 12, a camera's perspective of build-up is shown. In at least one embodiment, as shown, there may be four recognized build-up stages, including but not limited to, a no frost, light frost, moderate frost, and excessive frost stage. Similar to the analysis above the no frost stage may indicate that a HLWDP may be unnecessary. The light frost may similarly indicate that a HLWDP may be unnecessary, but may be initiated, if desired. The moderate frost stage may indicate that a HLWDP is necessary but may be delayed, if desired. An excessive frost stage may require an HLWDP to be initiated either substantially immediately or at the next opportunity. However, one skilled in the art should appreciate that any frost stage may signal the request for any beginning, end, pause, or continuation of any process.

In some embodiments, the wash tray may additionally or alternatively have one or more cameras or sensors. In one embodiment, the tray may have a sensor to prevent overflow of the tray. The sensor may sense when the hot liquid from the wash is approaching the rim of the wash tray 330. In another embodiment, the sensor may detect when there is no more frost or ice present. The sensor may then send a signal to stop the manifold from further releasing hot liquid. The signal delivery may be wired, wireless, or any other suitable means to transfer data.

For purposes of this disclosure, any system described herein may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, a system or any portion thereof may be a personal computer (e.g., desktop or laptop), tablet computer, mobile device (e.g., personal digital assistant (PDA) or smart phone), server (e.g., blade server or rack server), a network storage device, or any other suitable device or combination of devices and may vary in size, shape, performance, functionality, and price. A system may include random access memory (RAM), one or more processing resources such as a central processing unit (CPU) or hardware or software control logic, ROM, and/or other types of nonvolatile memory. Additional components of a system may include one or more disk drives or one or more mass storage devices, one or more network ports for communicating with external devices as well as various input and output (I/O) devices, such as a keyboard, a mouse, touchscreen and/or a video display. Mass storage devices may include, but are not limited to, a hard disk drive, floppy disk drive, CD-ROM drive, smart drive, flash drive, or other types of non-volatile data storage, a plurality of storage devices, or any combination of storage devices. A system may include what is referred to as a user interface, which may generally include a display, mouse or other cursor control device, keyboard, button, touchpad, touch screen, microphone, camera, video recorder, speaker, LED, light, joystick, switch, buzzer, bell, and/or other user input/output device for communicating with one or more users or for entering information into the system. Output devices may include any type of device for presenting information to a user, including but not limited to, a computer monitor, flat-screen display, or other visual display, a printer, and/or speakers or any other device for providing information in audio form, such as a telephone, a plurality of output devices, or any combination of output devices. A system may also include one or more buses operable to transmit communications between the various hardware components.

One or more programs or applications, such as a web browser, and/or other applications may be stored in one or more of the system data storage devices. Programs or applications may be loaded in part or in whole into a main memory or processor during execution by the processor. One or more processors may execute applications or programs to run systems or methods of the present disclosure, or portions thereof, stored as executable programs or program code in the memory, or received from the Internet or other network. Any commercial or freeware web browser or other application capable of retrieving content from a network and displaying pages or screens may be used. In some embodiments, a customized application may be used to access, display, and update information.

Hardware and software components of the present disclosure, as discussed herein, may be integral portions of a single computer or server or may be connected parts of a computer network. The hardware and software components may be located within a single location or, in other embodiments, portions of the hardware and software components may be divided among a plurality of locations and connected directly or through a global computer information network, such as the Internet.

As will be appreciated by one of skill in the art, the various embodiments of the present disclosure may be embodied as a method (including, for example, a computer-implemented process, a business process, and/or any other process), apparatus (including, for example, a system, machine, device, computer program product, and/or the like), or a combination of the foregoing. Accordingly, embodiments of the present disclosure may take the form of an entirely hardware embodiment, an entirely software embodiment (including firmware, middleware, microcode, hardware description languages, etc.), or an embodiment combining software and hardware aspects. Furthermore, embodiments of the present disclosure may take the foam of a computer program product on a computer-readable medium or computer-readable storage medium, having computer-executable program code embodied in the medium, that define processes or methods described herein. A processor or processors may perform the necessary tasks defined by the computer-executable program code. Computer-executable program code for carrying out operations of embodiments of the present disclosure may be written in an object oriented, scripted or unscripted programming language such as Java, Perl, PHP, Visual Basic, Smalltalk, C++, or the like. However, the computer program code for carrying out operations of embodiments of the present disclosure may also be written in conventional procedural programming languages, such as the C programming language or similar programming languages. A code segment may represent a procedure, a function, a subprogram, a program, a routine, a subroutine, a module, an object, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

In the context of this document, a computer readable medium may be any medium that can contain, store, communicate, or transport the program for use by or in connection with the systems disclosed herein. The computer-executable program code may be transmitted using any appropriate medium, including but not limited to the Internet, optical fiber cable, radio frequency (RF) signals or other wireless signals, or other mediums. The computer readable medium may be, for example but is not limited to, an electronic, magnetic, optical, electromagnetic, infrared, or semiconductor system, apparatus, or device. More specific examples of suitable computer readable medium include, but are not limited to, an electrical connection having one or more wires or a tangible storage medium such as a portable computer diskette, a hard disk, a random access memory (RAM), a read-only memory (ROM), an erasable programmable read-only memory (EPROM or Flash memory), a compact disc read-only memory (CD-ROM), or other optical or magnetic storage device. Computer-readable media includes, but is not to be confused with, computer-readable storage medium, which is intended to cover all physical, non-transitory, or similar embodiments of computer-readable media.

Various embodiments of the present disclosure may be described herein with reference to flowchart illustrations and/or block diagrams of methods, apparatus (systems), and computer program products. It is understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks. Alternatively, computer program implemented steps or acts may be combined with operator or human implemented steps or acts in order to carry out an embodiment of the invention.

Additionally, although a flowchart may illustrate a method as a sequential process, many of the operations in the flowcharts illustrated herein can be performed in parallel or concurrently. In addition, the order of the method steps illustrated in a flowchart may be rearranged for some embodiments. Similarly, a method illustrated in a flow chart could have additional steps not included therein or fewer steps than those shown. A method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A liquid wash defrosting apparatus that uses captured heat from a cold-hot process, the apparatus comprising:

a manifold, wherein the manifold is adapted to expel a liquid onto an evaporator component:

one or more cold liquid pipes adapted to deliver the liquid to a cold liquid reservoir, the cold liquid reservoir comprising one or more transfer pipes adapted to transferring the liquid to a container, the container comprising a mechanism for heating the liquid; and one or more heated liquid pipes adapted to deliver the liquid from the container to the manifold.

2. The apparatus of claim 1, wherein the mechanism for heating the liquid comprises one or more hot pipes arranged to cooperate with the container, wherein the one or more hot pipes is adapted to heat the heated liquid within the container.

3. The apparatus of claim 1, wherein the container is comprised of one or more insulated walls.

4. The apparatus of claim 1, further comprising, a tray arranged to capture the expelled liquid.

5. The apparatus of claim 1, further comprising, a container pump arranged within the container, the pump adapted to deliver the liquid to the manifold.

6. The apparatus of claim 4, further comprising a cold liquid pump cooperating with the tray and adapted at least to deliver the liquid to the container or the cold liquid reservoir.

7. The apparatus of claim 1, further comprising a sensor adapted to determine whether the temperature of the liquid in the container.

8. The method of claim 1, wherein capturing the liquid and the build-up further comprises pumping the liquid and build-up to a cold liquid reservoir before delivering the liquid to the container.

9. A method for defrosting evaporator coils to increase tissue preservation that uses captured heat from a cold-hot process, comprising:

heating a liquid using one or more heated pipes, wherein the one or more heated pipes are comprised of coolant pipes, the coolant pipes comprising part of a hot-cold method, the hot-cold method comprising:

the one or more coolant pipes existing in a closed s system, the pipes containing a coolant, the closed system having a compressor, a condenser, and an evaporator component;

delivering the liquid to a manifold;

expelling the liquid onto an evaporator component to wash away a build-up;

capturing the liquid and the build-up; and delivering the liquid to a container.

10. The method of claim 9, wherein the build-up comprises frost and ice accumulation.

11. The method of claim 9, wherein capturing the liquid and the build-up comprises of receiving the liquid and build-up in a tray.

12. The method of claim 9, wherein delivering the liquid to the manifold comprises pumping the liquid with a container pump from the container to the manifold.

* * * * *